US005330314A

United States Patent [19]

Bennison

[11] Patent Number: 5,330,314

[45] Date of Patent: Jul. 19, 1994

[54] VACUUM LIFTING/LOWERING HEAD

[75] Inventor: Stewart Bennison, Chesterfield, England

[73] Assignee: Palamatic Handling Systems Limited, Chesterfield, United Kingdom

[21] Appl. No.: 814,567

[22] Filed: Dec. 30, 1991

[30] Foreign Application Priority Data

Jan. 3, 1991 [GB] United Kingdom ..... 9100056

[51] Int. Cl.[5] ..... B66C 1/02

[52] U.S. Cl. ..... 414/627; 294/64.1

[58] Field of Search ..... 414/627, 626, 617, 737, 414/752; 901/40; 294/64.1

[56] References Cited

U.S. PATENT DOCUMENTS

| | | | |
|---|---|---|---|
| 22,551 | 1/1859 | Duchamn | 294/64.1 |
| 3,313,568 | 4/1967 | Fogg | 294/64.1 |
| 3,322,221 | 5/1967 | Engelen et al. | 294/64.1 X |
| 3,743,340 | 7/1973 | Williamann | 414/627 X |
| 3,751,095 | 8/1973 | Myles | 294/64.1 |
| 3,999,795 | 12/1976 | Barker | 294/64.1 |
| 4,412,775 | 11/1983 | Molitor et al. | 414/627 X |
| 4,413,853 | 11/1983 | Andersson | 414/627 X |
| 4,750,768 | 6/1988 | Kumar | 294/64.1 |
| 5,035,456 | 1/1991 | Messinger | 901/40 X |

FOREIGN PATENT DOCUMENTS

| | | |
|---|---|---|
| 3618704C1 | 6/1987 | Fed. Rep. of Germany . |
| 2080764B | 2/1984 | United Kingdom . |
| 2200615A | 8/1988 | United Kingdom . |

*Primary Examiner*—Frank E. Werner
*Assistant Examiner*—James T. Eller, Jr.
*Attorney, Agent, or Firm*—Trexler, Bushnell, Giangiorgi & Blackstone, Ltd.

[57] ABSTRACT

A vacuum lifting/lowering head comprises a fixed, steadying upper handle adapted, in use, to be gripped by the user, and a movable, lower handle displaceable under the manual control of the user, both handles being suitable for either left or right hand manual operation. An opening is provided in a part of the head, and a valve member is associated with the opening to control the extent of exposure thereof and displaceable by the user's manual movement of the lower handle. The invention also includes a vacuum lifting apparatus provided with such a head.

9 Claims, 4 Drawing Sheets

VACUUM LIFTING/LOWERING HEAD

BACKGROUND OF THE INVENTION

This invention relates to a vacuum lifting/lowering head, e.g. for use in conjunction with vacuum lifting apparatus, such as the general kind described in GB 2080764. The invention also includes said vacuum lifting flowering in combination head with such a vacuum lifting apparatus.

With such apparatus the expansion or contraction of the variable length, bellows-like lift tube is controlled by controlling the vacuum level within the tube, which level is in turn controlled by a user operable, or settable, valve to connect and/or isolate the interior of said lift take to atmosphere. Thus, in a fully open valve position, the tube interior is open to atmosphere, the vacuum within the tube is rapidly destroyed and, with the tube hanging vertically from a suspension point, the tube falls to its maximum expanded length. Conversely, in a fully closed valve position, the vacuum is at a maximum and the tube rises to its maximum contracted position—being in use a maximum lift height. It follows that intermediate opening of the valve achieves an intermediate position.

Previously proposals for valve arrangements for vacuum lifting/lowering heads have however been relatively complex and hence costly c.f. GB 2080764 and 2200615, and the object of the present invention is to provide a head of simple operation and hence of low manufacturing costs.

SUMMARY OF THE INVENTION

According to a first aspect of the invention, there is provided a vacuum lifting/lowering head for the handling of articles, comprising a housing, a resilient sealing lip provided around a lower portion of the housing and adapted, in use, to engage an article to be lifted/-lowered, a fixed, upper steadying handle attached to the housing and adapted to be gripped by the user to manoeuver the housing with respect to an article to be lifted/lowered, a movable lower handle attached to the housing and adapted to be manually displaceable by the user to control the position of a valve member which closes or reveals an opening in the housing for the admission, non-admission, or partial-admission of atmospheric air to the interior of the housing as part of lifting/lowering operations.

According to a second aspect of the invention, there is provided a vacuum lifting apparatus comprising a bellows like lift tube, the linear expansion or contraction of which is controlled by the vacuum level within the tube, incorporating a vacuum lifting head in accordance with the first aspect.

Thus, considering a vacuum lifting apparatus, with the palm of the user's hand gripping the fixed steadying handle, the user's fingers, directed downwardly, engage the movable lower handle so that, in practice, an upward pull on the movable handle closes off the opening, to achieve lifting, while a downward push on the movable handle exposes the opening, thereby destroying the vacuum in the associated lift tube so that, the vacuum lifting/lowering head, may be lowered into engagement with an article to be lifted, or alternatively, may be released from an article that has previously been lifted, moved and lowered.

The movable lower handle can be pivotally mounted, and hence constitute a lever, or can be mounted in a slide, or can have a link to the valve member. The latter may simply consist of a cover plate.

The opening, e.g. a cut out in a sheet metal casing of the housing, can be graduated to give better control, though this is not totally essential, as the aperture could consist of a circular hole, which would still perform quite acceptably. A graduated opening may conveniently be triangular. Alternatively, a similar effect can be achieved if the graduated opening is constituted by a plurality of diverging slots provided for example in the wall of a cylinder with an arcuately movable valve member preferably located internally of the cylinder.

Also, the movable lower handle is preferably of such construction that, upon release by the user—whether deliberate or accidental—the movable lower handle always remains in its release position. Whilst a spring and stop may be provided, to ensure that the cover plate always moves to a pre-set position, preferably when no spring or stop is provided the valve will "stay put", giving, when incorporated into vacuum lifting apparatus in accordance with the second aspect, automatic balance against the load being lifted. A spring-loaded ball catch or other safety device could be added if desired to prevent accidental movement of the valve member to the fully open position. A simple lever on the side of the fixed handle could be added, if desired to act against an adjustable stop. This would again be a safety device but would be even more positive than above as it would require an even more positive action to move the valve into the release mode. When incorporated into vacuum lifting apparatus in accordance with the second aspect, the movable lower handle or lever would normally be pulled upwards to raise the load and pushed down to lower the load. To push the handle fully down would move the valve into the release mode and it is in advance of this position that the ball catch would operate, or movement would be stopped by action of the user to prevent high speed lowering. Thus, the rate of descent may be set, with prevention of entry into the release only when positively activated by the user.

Conveniently, the housing may consist of an endless sheet metal wall of (generally) rectangular, circular or other shape, with the opening formed in a portion of the wall, and with the lower edge of the wall provided with the resilient lip, e.g. of soft rubber or other elastomeric material, secured to the wall either as a push-fit, or by adhesive.

In the vicinity of the opening, the wall is conveniently provided with bracket means forming a pivot point a pivotable type lower handle. Furthermore, resilient biassing means, such as one or more springs, which could have adjustable loading, may be operable on the valve member to urge the latter into light, frictional engagement with the wall adjacent the opening.

The fixed steadying handle is preferably an endless loop of tubular steel secured, e.g. by welding to the housing, while the movable lower handle may be of wire rod bent generally to "U"-shape.

BRIEF DESCRIPTION OF THE DRAWINGS

Examples of a vacuum lifting head, and vacuum lifting apparatus in accordance with the two aspects of the invention will now be described in greater detail, with reference to the accompanying drawings, in which.

In all embodiments, like components are accorded like reference numerals.

DESCRIPTION OF THE PREFERRED EMBODIMENTS

Figure 1:
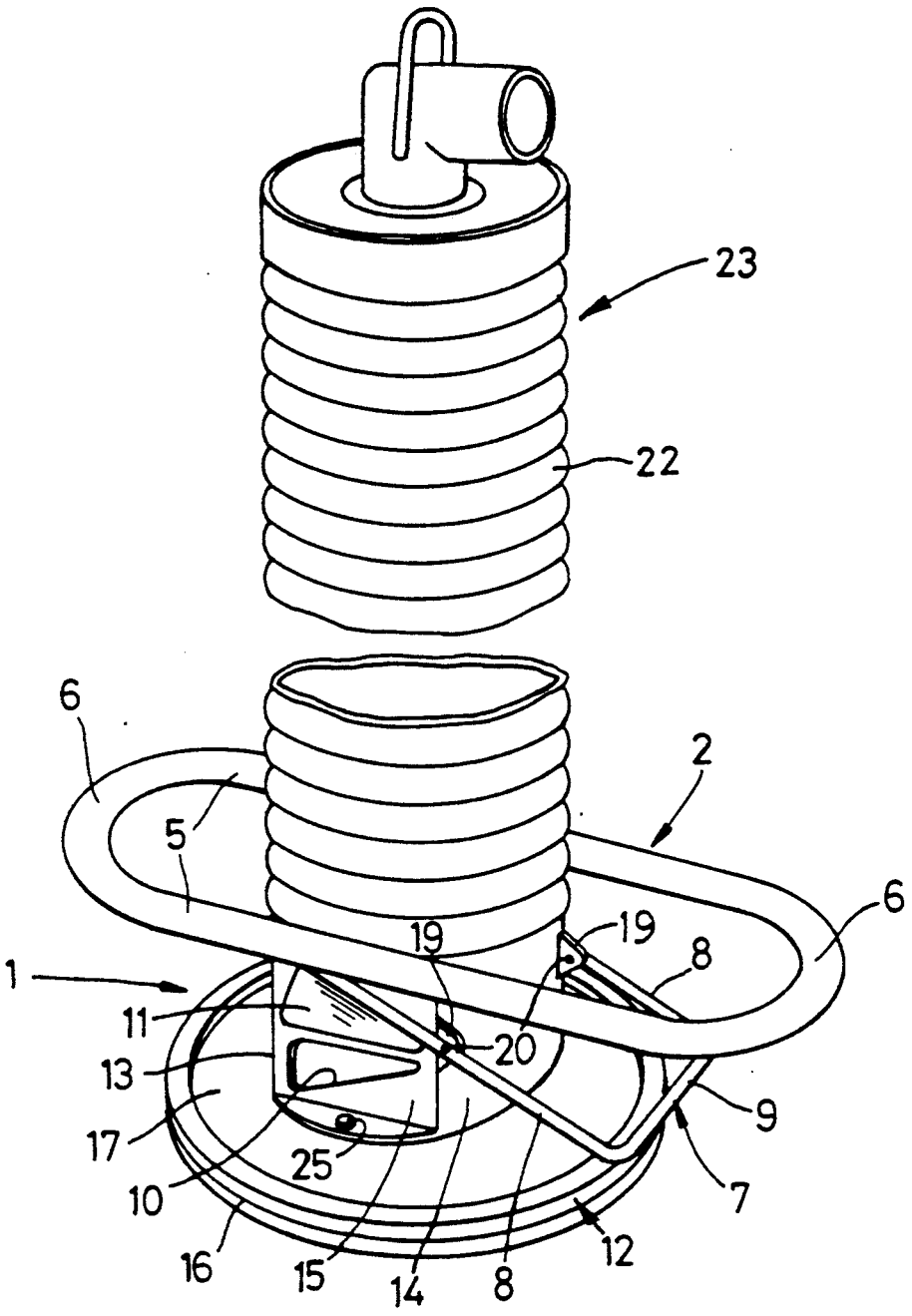
FIG. 1 is a perspective view of a first embodiment of vacuum lifting apparatus in accordance with the second aspect incorporating a head in accordance with the first aspect.

A vacuum lifting/lowering head 12 comprises a fixed, steadying upper handle 2 adapted to be gripped by the left or right hand 3 of a user 4, the fixed handle 2 being an endless loop of tubular steel and comprising two parallel portions 5 with semi-circular bends 6 for comfortable grip by the user. The head 12 also comprises a movable lower handle 7 suitable for either left or right hand manual operation, being of steel wire rod, bent to "U"-shape and hence comprising two parallel arms 8 and an inter-connecting strap 9. A triangular opening 10 is provided in a part of the head 12, and a correspondingly triangular valve member 11 in the form of a simple cover plate is attached to one arm 8, e.g. by welding, and is associated with the opening 10 to control the extent of exposure thereof, and displaceable by the user's movement of the lower handle 7.

The vacuum-lifting head 12 further comprising a housing 13 comprising a generally tubular sheet metal wall 14 with a flat wall portion 15 in which the opening 10 is cut with a resilient sealing lip 16 provided around an enlarged annular plate 17 secured by bolts 25 to the head 12 and adapted, in use, to engage an article 18 to be lifted. In the vicinity of the opening 10, the wall 14 is conveniently provided with bracket means 19 forming a pivot point 20 for pivotable attachment of the lower handle 7. Furthermore, the light frictional engagement of the valve member 11 with the wall 15 adjacent the opening 10 is so arranged that, upon release of lower handle 7 by the user, the handle 7, and hence the valve member 11, remains in its release position, giving automatic balance of the load of any article 18 being lifted/-lowered at that moment.

A spring-loaded ball catch 21 (FIG. 3) or other safety device such as a mechanical stop could be added if desired to prevent accidental release of an article 18 and/or high speed lowering.

The vacuum lifting head 12 forms part of a vacuum lifting apparatus 22 comprising a linearly expandable and contractable bellows-like lift tube 23 connected to a vacuum pump (not shown), with the expansion or contraction of the tube controlled in a manner known per se by control of the vacuum level within the tube 23 created by a remotely located vacuum pump (not shown).

Figure 2:
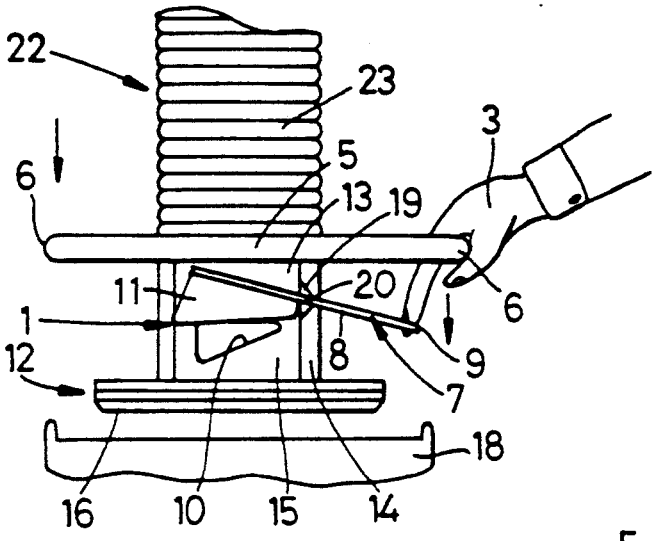
FIGS. 2, 3 and 4 illustrate different sequences of operation of the apparatus of FIG. 1.
Figure 3:
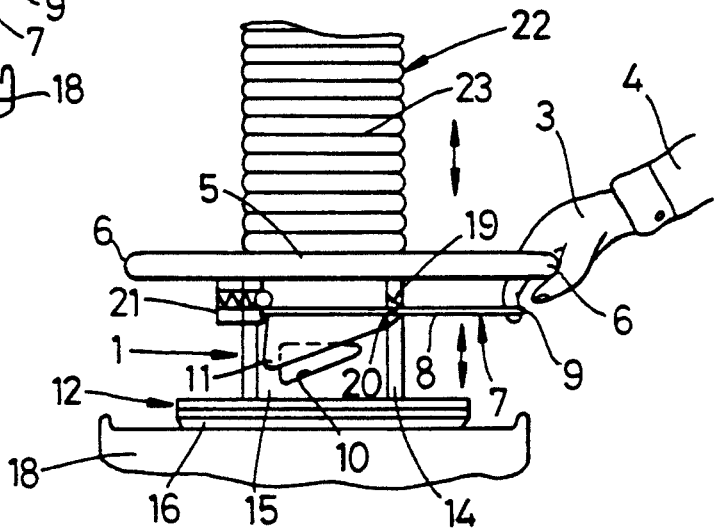
Figure 4:
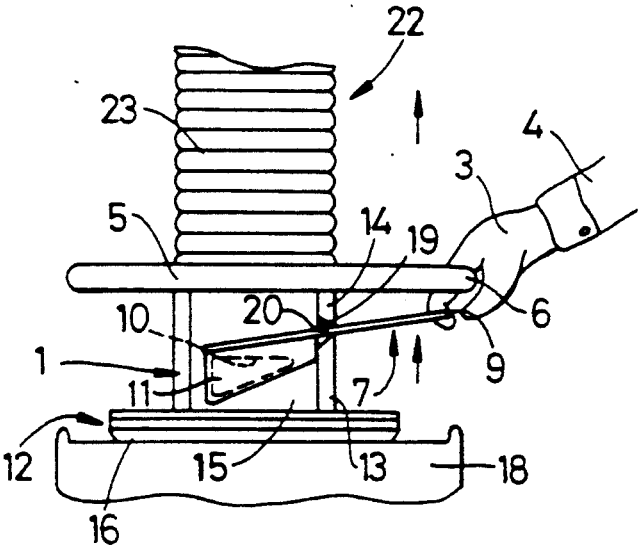

The mode of operation is illustrated in FIGS. 2 to 4. With the opening 10 completely closed off by the valve member 11, a maximum vacuum level exists within the lift tube 23, which therefore contracts, bellows-like, to its minimum length, so that the vacuum lifting head 12 is at its maximum height. Hence, the first requirement is for the user to lower the head 12 until it engages an article 18 to be lifted, relocated and then lowered. Thus, with the palm of the user's hand 3 gripping the fixed steadying handle 2 the user's fingers, directed downwardly, engage and push downwardly on the lower movable handle 7 as illustrated in FIG. 2. This exposes the aperture 10, destroys the vacuum within the lift tube 23 by the in-rush of atmospheric air through the opening 10 exceeding the evacuation capacity of the associated vacuum pump, until the lifting head 12 suspended by the somewhat "floppy" tube 23, contacts the article 18 under the guidance of the user by suitably manoeuvering the fixed steadying handle 2. Then, an upward pull on the movable handle 7, as illustrated in FIG. 3, partially closes off the opening 10 to re-establish a vacuum within both the lift tube 23 and lifting head 12. With partial opening, or conversely partial closing, of the opening 10 by the valve member 11, to an extent controlled by the user, the article 18 is gripped and is in a hover mode, at a user-controllable height. With further upward movement by the user on the movable handle 7, the opening 10 is completely closed off by the valve member 11 and the article 18 may be raised to maximum height and relocated. It follows that in the re-located position, partial exposure of the opening 10 by user-control of the valve member 11 lowers the lift head 12 and article 18, while full exposure releases an article 18 that has previously been lifted, moved and lowered.

Figure 5:
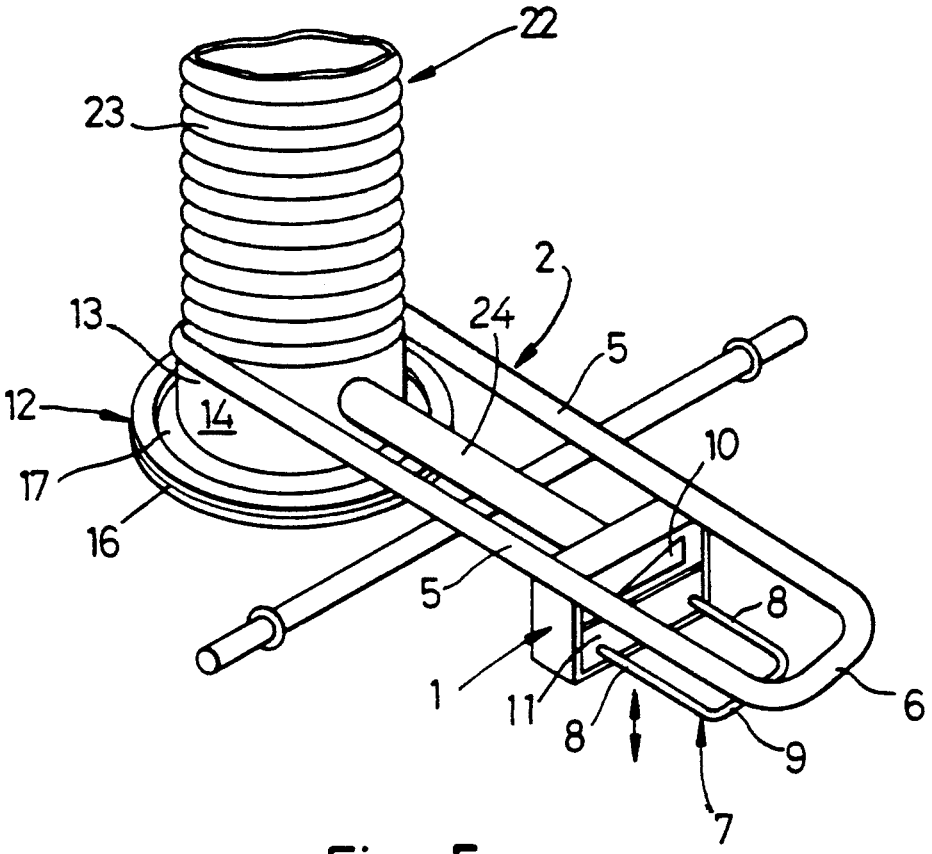
FIG. 5 corresponds to FIG. 1 but shows a second embodiment.

In FIG. 5 is illustrated an embodiment in which the valve arrangement 1 is removed from the head 12 and is at a remote location from the lifting head 12, being attached, e.g. by welding, to the underside of an extended steadying handle 2 and connected to the head 12, and hence to the interior of the lift tube 23, by a vacuum/air flow conduit 24. The lower handle 7 is linearly movable in this embodiment, whilst the valve member 11 is a rectangular slide plate.

Figure 6:
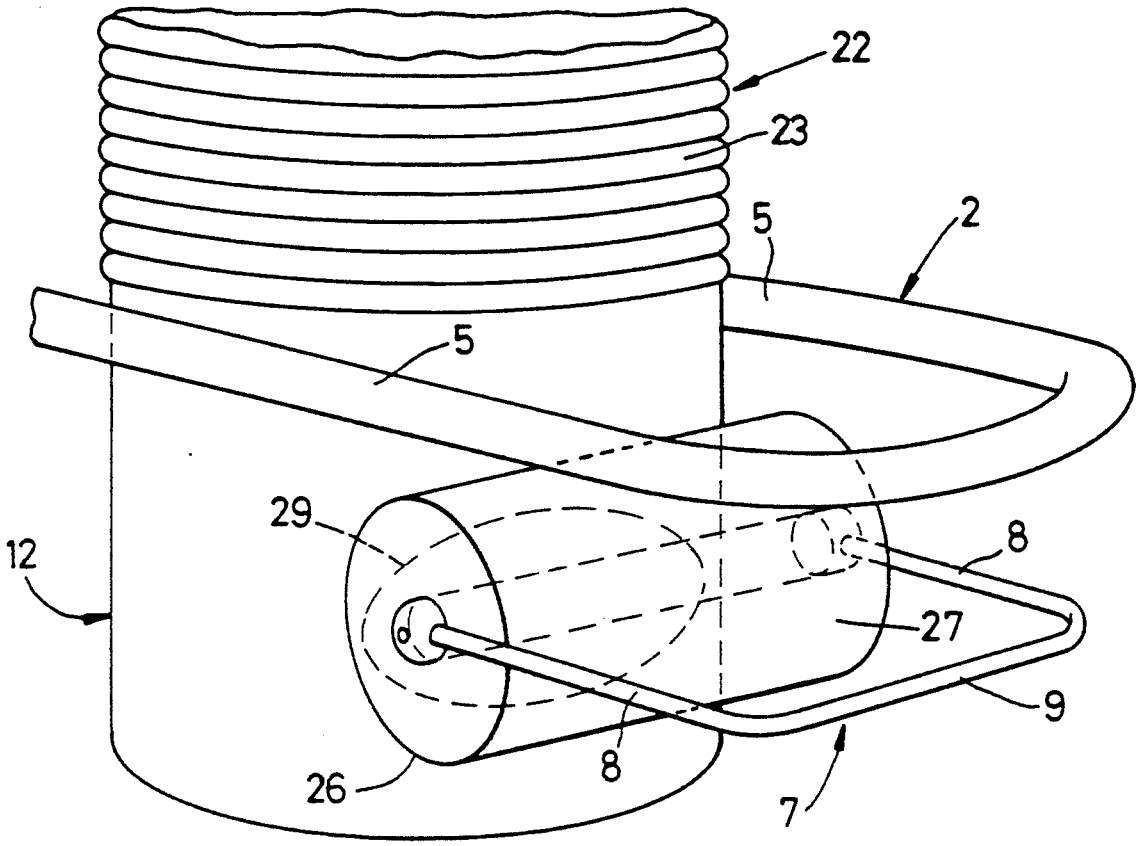
FIGS. 6 and 7 show an alternative valve arrangement.
Figure 7:
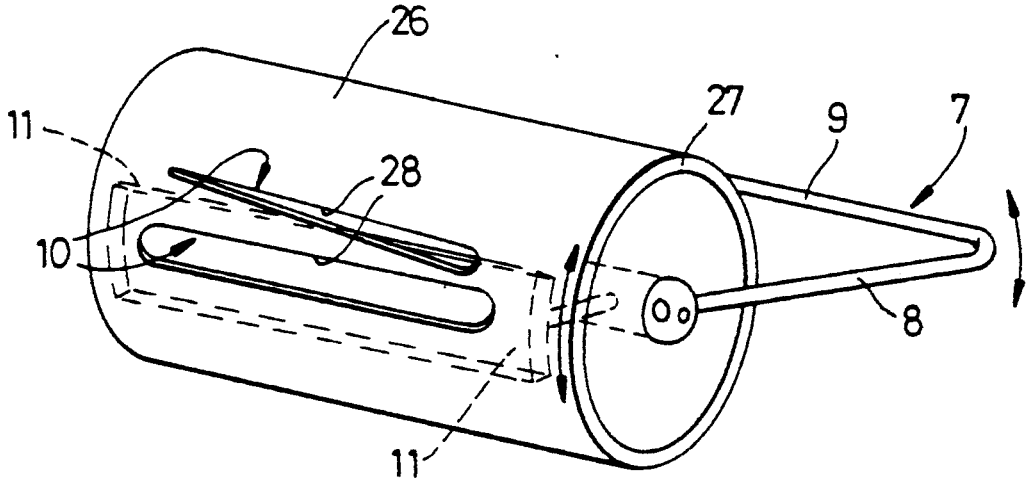

In the alternative valve arrangement shown in FIGS. 6 and 7, a cylinder 26 has a circumferential wall 27 in which is cut a pair of diverging slots 28, the exposure or non-exposure of the slots 28 being controlled by an arcuately movable valve member 11 located within the cylinder 26 and attached to the movable lower handle 7. An oval aperture 29 is cut into the metal wall 14 of the lifting head 12 and the cylinder 26 is welded or otherwise secured to the head 12 with its slots 28 in air-flow communication with the interior of the head 12 via the aperture 29.

I claim:

1. A vacuum lifting/lowering head for the handling of articles comprising a housing; a resilient sealing lip provided around a lower portion of said housing and adapted, in use, to engage an article to be lifted/lowered; a fixed, upper steadying handle attached to said housing and adapted to be engaged by a user's hand to manoeuver said housing with respect to an article to be lifted/lowered; an opening in said housing, a displaceable valve member associated with said opening to close or reveal said opening, and a movable lower handle pivotally attached to said housing, with which lower handle said valve member is movable, and adapted to be manually displaceable by the fingers of the user's same hand to control the position of said valve member for the admission, non-admission, or partial-admission of atmospheric air to an interior of said housing as part of lifting/lowering operations; with said movable lower handle of such construction that upon deliberate or accidental release by the user, said movable lower handle always remains in the position at which it was located at the moment of said release.

2. A head as claimed in claim 1, wherein the said valve member is a cover plate.

3. A head as claimed in claim 1, wherein said opening is graduated.

4. A head as claimed in claim 1, wherein said fixed steadying handle is a loop of tubular steel.

5. A head as claimed in claim 1, wherein said movable, lower handle is a wire rod, bent to "U"-shape.

6. A head as claimed in claim 1, wherein said housing comprises an endless metallic wall.

7. A head as claimed in claim 1, wherein a plurality of diverging slots constitute said opening.

8. A head as claimed in claim 7, comprising a cylinder having a wall, with said slots provided in said wall, and with an arcuately movable valve member to control exposure, or non-exposure of said slots.

9. A vacuum lifting/lowering apparatus comprising an expandable and contractable, bellows-like lift tube, said expansion and contraction of which is controlled by the vacuum level within said tube, incorporating a vacuum lifting/lowering head comprising a housing, a resilient sealing lip provided around a lower portion of said housing and adapted, in use, to engage an article to be lifted/lowered, a fixed, upper steadying handle attached to said housing and adapted to be engaged by a user's hand to manoeuver said housing with respect to an article to be lifted/lowered, an opening in said housing, a displaceable valve member associated with said opening to close or reveal said opening, and a movable, lower handle attached to said housing, with which lower handle said valve member is movable, and adapted to be manually displaceable by the fingers of the user's same hand to control the position of said valve member for the admission, non-admission, or partial-admission of atmospheric air to an interior of said housing as part of lifting/lowering operations; with said movable lower handle of such construction that upon deliberate or accidental release by the user, said movable lower handle always remains in the position at which it was located at the moment of release.

* * * * *